US008701610B2

(12) United States Patent
Schwarzenthal et al.

(10) Patent No.: US 8,701,610 B2
(45) Date of Patent: Apr. 22, 2014

(54) INTERNAL COMBUSTION ENGINE AND VALVE DRIVE FOR AN INTERNAL COMBUSTION ENGINE

(75) Inventors: Dietmar Schwarzenthal, Ditzingen (DE); Joachim Gruenberger, Sachsenheim (DE)

(73) Assignee: Dr. Ing. h.c. F. Porsche Aktiengesellschaft, Stuttgart (DE)

( * ) Notice: Subject to any disclaimer, the term of this patent is extended or adjusted under 35 U.S.C. 154(b) by 139 days.

(21) Appl. No.: 13/571,641

(22) Filed: Aug. 10, 2012

(65) Prior Publication Data

US 2013/0047944 A1 Feb. 28, 2013

(30) Foreign Application Priority Data

Aug. 23, 2011 (DE) ..... 10 2011 052 912

(51) Int. Cl.
*F01L 1/34* (2006.01)

(52) U.S. Cl.
USPC ..... 123/90.18; 123/90.16

(58) Field of Classification Search
USPC ..... 123/90.16, 90.18
See application file for complete search history.

(56) References Cited

U.S. PATENT DOCUMENTS

| | | | | |
|---|---|---|---|---|
| 7,409,938 | B2 * | 8/2008 | Dengler | 123/90.18 |
| 2011/0180029 | A1 | 7/2011 | Arnold et al. | |
| 2012/0037102 | A1 | 2/2012 | Meintschel et al. | |

FOREIGN PATENT DOCUMENTS

| | | | |
|---|---|---|---|
| DE | 19611641 | C1 | 6/1997 |
| DE | 10 2007 061 353 | A1 | 6/2009 |
| DE | 10 2008 060 169 | A1 | 6/2010 |
| DE | 102008060166 | A1 | 6/2010 |
| DE | 10 2009 008 422 | A1 | 8/2010 |
| DE | 10 2010 005 790 | A1 | 7/2011 |

* cited by examiner

*Primary Examiner* — Zelalem Eshete
(74) *Attorney, Agent, or Firm* — RatnerPrestia

(57) ABSTRACT

An internal combustion engine having a cylinder head and a cylinder head cover, wherein in order to activate charge cycle valves, at least one rotatably mounted cam shaft is provided with at least one sliding cam which can be slid axially on the respective cam shaft, wherein the respective sliding cam has at least one slotted link section with at least one groove, wherein in order to bring about axial sliding of the respective sliding cam, an actuator is provided, and wherein after axial sliding on the respective cam shaft, the respective sliding cam can be latched in its axial relative position relative to a charge cycle valve to be activated by a locking device which has a first latching element with a plurality of latching depressions and at least one second latching element which interacts with the first latching element.

9 Claims, 4 Drawing Sheets

INTERNAL COMBUSTION ENGINE AND VALVE DRIVE FOR AN INTERNAL COMBUSTION ENGINE

CROSS-REFERENCE TO RELATED APPLICATIONS

Priority is claimed to German Patent Application DE 10 2011 052 912.8, filed Aug. 23, 2011, which is incorporated by reference herewith in its entirety.

FIELD OF THE INVENTION

The invention relates to an internal combustion engine and a valve drive for an internal combustion engine.

BACKGROUND OF THE INVENTION

In modern internal combustion engines, variable valve drives are used to optimize the charging movement in the combustion chamber, with which valve drives different valves strokes can be set at the charge cycle valves of the internal combustion engine. DE 196 11 641 C1, which is incorporated by reference herein, discloses a valve drive of an internal combustion engine which makes it possible to activate a charge cycle valve with a plurality of different lifting cams. For this purpose, a sliding cam with a plurality of cam tracks is mounted on the cam shaft in a rotationally fixed but axially slideable fashion, which sliding cam has a lifting contour into which an activation element, embodied as a pin, of an actuator engages in order to generate axial sliding of the cam. The axial sliding of the cam sets the respective valve stroke.

DE 10 2008 060 166 A1, which is incorporated by reference herein, discloses a valve drive in which a sliding cam, which is mounted on a cam shaft in a rotationally fixed but axially slideable fashion, has a slotted link section with a plurality of grooves, and in which, in order to bring about axial sliding of the sliding cam, an actuator is provided with a plurality of pins which can be activated. The slotted link section has a first, right-handed thread groove and a second, left-handed thread groove which are arranged next to one another on the circumference of the slotted link section and merge with a common run-out groove. The pins of the actuator interact with the grooves of the slotted link section.

In addition, a valve drive is already known in which the grooves of the slotted link section are positioned one behind the other on the circumference of the slotted link section, specifically a first groove for axially sliding the sliding cam in a first direction and a second groove for axially sliding the sliding cam in an opposite, second direction. In this valve drive too, the actuator comprises, in order to bring about the axial sliding of the sliding cam, a plurality of pins which can be activated, specifically a first pin for axially sliding the sliding cam in both directions about a first axial segment, and a second pin for axially sliding the sliding cam in both directions about a second axial segment.

The pins of the actuator, which interact with the grooves of the slotted link section of the sliding cam in order to bring about the axial sliding of the sliding cam, are, as is known from DE 10 2008 060 166 A1, latched in a housing of the actuator by means of latching elements embodied as latching balls, and are therefore secured, wherein, in order to release the latched connection of the pins, the actuator, specifically an electromagnet thereof, is energized in order to cancel the latched connection of the pins in the housing of the actuator which is brought about by means of the latching elements.

The pins of the actuator which are released by the energization thereof can be moved axially in the radial direction of the sliding cam or slotted link section of the sliding cam in order to engage in a groove in the slotted link section.

In the multi-stage valve drives which are known from the prior art and whose actuators have a plurality of pins and the slotted link sections of the sliding cam thereof have a plurality of grooves, there is the problem that during the axial adjustment of the sliding cam on the cam shaft, considerable surface pressures occur between the actuator and the sliding cam. In addition, in such valve drives which are known from the practice, relatively wide sliding cams are necessary in order to comply with system tolerances, which results in a heavy weight of the sliding cam and the abovementioned surface pressures increase further. This is disadvantageous.

SUMMARY OF THE INVENTION

An internal combustion engine has a plurality of cylinders, a cylinder head and a cylinder head cover which is embodied separately from the cylinder head or in one piece with the cylinder head, wherein in order to activate charge cycle valves, at least one rotatably mounted cam shaft is provided with at least one sliding cam which can be slid axially on the respective cam shaft, wherein the respective sliding cam has at least one slotted link section with at least one groove formed on an outer lateral surface of the respective slotted link section, wherein in order to bring about axial sliding of the respective sliding cam, an actuator is provided, and wherein after axial sliding on the respective cam shaft, the respective sliding cam can be latched in its axial relative position relative to a charge cycle valve to be activated by a locking device which has a first latching element with a plurality of latching depressions and at least one second latching element which interacts with the first latching element, wherein a sliding piece which is engaged with a first section of said sliding piece with the respective groove of the respective slotted link section and which can be placed in engagement at a second section with the actuator in order to axially slide the sliding cam.

A valve drive for an internal combustion engine, which, in order to activate charge cycle valves of the internal combustion engine, has at least one rotatably mounted cam shaft with at least one sliding cam which can be slid axially on the respective cam shaft, wherein the respective sliding cam has at least one slotted link section with at least one groove formed on an outer lateral surface of the respective slotted link section, wherein in order to bring about axial sliding of the respective sliding cam, an actuator is provided, slotted link and wherein after axial sliding on the respective cam shaft, the respective sliding cam can be latched in its axial relative position relative to a charge cycle valve to be activated by a locking device which has a first latching element with a plurality of latching depressions and at least one second latching element which interacts with the first latching element, characterized by a sliding piece which is engaged with a first section of said sliding piece with the respective groove of the respective slotted link section and which can be placed in engagement at a second section with the actuator in order to axially slide the sliding cam.

According to aspects of the invention, the valve drive comprises a sliding piece which is engaged by its first section with the respective groove of the respective slotted link section and which can be placed in engagement at a second section with the actuator in order to axially slide the sliding cam.

Due to the fact that in the valve drive, according to aspects of the invention, the sliding piece is used between the sliding cam, specifically the slotted link section thereof, and the actuator, an actuator with a plurality of pins can be dispensed with.

This makes it possible to make available a multi-stage valve drive using an actuator with exclusively a single pin. As a result, relatively low system tolerances are produced, as well as reduced surface pressures between the sliding cam and the actuator, specifically between the sliding cam, sliding piece and actuator. Accordingly, with the valve drive, according to aspects of the invention, it can be possible to avoid the disadvantages of the valve drives which are known from the prior art.

The respective slotted link section preferably has a plurality of grooves which are positioned one behind the other on the circumference of the slotted link section, specifically a first groove for axially sliding the sliding cam in a first direction and a second groove for axially sliding the sliding cam in an opposite, second direction, wherein in order to bring about the axial sliding of the respective sliding cam in both directions, the actuator is engaged in a positively locking fashion about a first axial segment with a first region of the second section of the sliding piece, and, in order to bring about the axial sliding of the respective sliding cam in both directions, the actuator is engaged in a positively locking fashion about a second axial segment with a second region of the second section of the sliding piece. This configuration of a valve drive or of an internal combustion engine with a valve drive permits in a structurally simple way, while ensuring low system tolerances and reduced surface pressures, that a valve drive can be made available whose sliding cam can be moved in two axial directions in an incremental fashion, in particular between three different positions.

According to an advantageous development of the invention, a sliding sleeve which can slide axially together with the respective sliding cam, and which makes available the first latching element with the plurality of latching depressions, is positioned radially on the outside of the respective sliding cam, wherein the sliding piece is guided in an axially slideable fashion in the sliding sleeve, specifically in such a way that when the sliding cam is axially fixed and the sliding sleeve is axially fixed, the sliding piece which is released by the actuator can be moved relative to the sliding sleeve, whereas when the sliding piece is axially fixed by the actuator, the sliding sleeve can be moved with simultaneous axial sliding of the sliding cam relative to the sliding piece.

BRIEF DESCRIPTION OF THE DRAWINGS

Further features and feature combinations can be found in the description. Specific exemplary embodiments of the invention are illustrated in simplified form in the drawing and explained in more detail in the following description, in which.

DETAILED DESCRIPTION OF THE DRAWINGS

Figure 1:
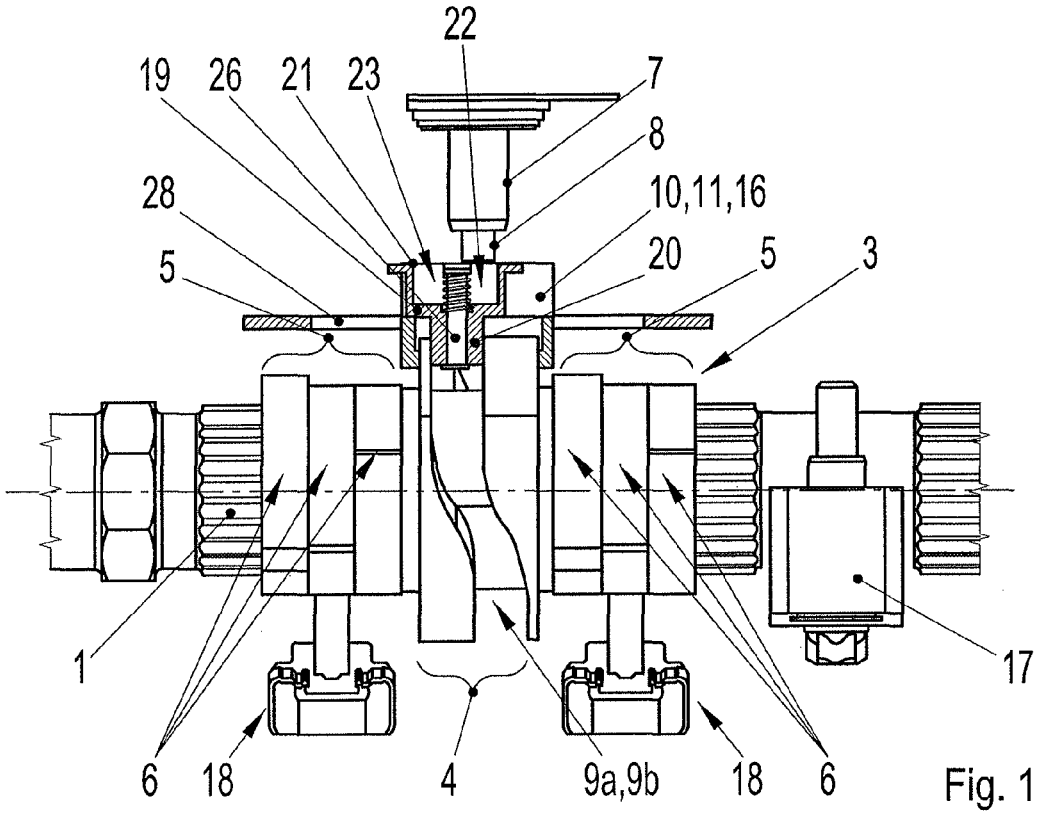
FIG. 1 shows a schematic detail of a preferred exemplary embodiment of an inventive valve drive of an internal combustion engine in a side view.

FIG. 1 shows a detail from an internal combustion engine in the region of a cam shaft 1 of a valve drive of the internal combustion engine. The cam shaft 1 shown in FIG. 1 is mounted in a cylinder head (not shown) of the internal combustion engine by means of cam shaft bearings 17, which cylinder head is preferably composed of a cylinder head lower part and a cam shaft housing. The cylinder head lower part and cam shaft housing can also be embodied in one piece.

The cam shaft 1 shown in FIG. 1 is embodied as an inlet cam shaft and serves to control inlet valves 2 of the internal combustion engine using cam followers 18. In order to control outlet valves (not shown) of the internal combustion engine, an outlet cam shaft (not shown) is present. The inlet valves and outlet valves are charge cycle valves of the internal combustion engine.

Preferably two inlet valves 2 and two outlet valves (not shown) are provided per cylinder, wherein the inlet valves 2 are activated controlled in a known fashion by the inlet cam shaft 1. The outlet valves are activated controlled in a known fashion by the outlet cam shaft (not shown). For this purpose, the inlet cam shaft 1 and the outlet cam shaft (not shown) each have a plurality of sliding cams 3.

The sliding cam 3 is formed from a slotted link section 4 positioned in the center and two outer cam sections 5. In the exemplary embodiment shown, each outer cam section 5 comprises three cam tracks 6, wherein a different valve stroke is set with each of the cam tracks 6. The sliding cam 3 accordingly comprises, for each valve, a cam section 5 which has three cam tracks 6 and can be slid axially.

Each sliding cam 5 is assigned an actuator 7 which has a single pin 8 which interacts by means of a sliding piece 19 (described further below in detail) with grooves 9*a*, 9*b*, embodied on a lateral surface of the slotted link section 4, of the sliding cam 3. As a result, axial sliding of the sliding cam 3 takes place on the cam shaft 1. The axial sliding of the sliding cam 3 causes the respective charge cycle valve to be selectively activated with a specific cam track 6, with the result that a different valve stroke setting is brought about.

Figure 3:
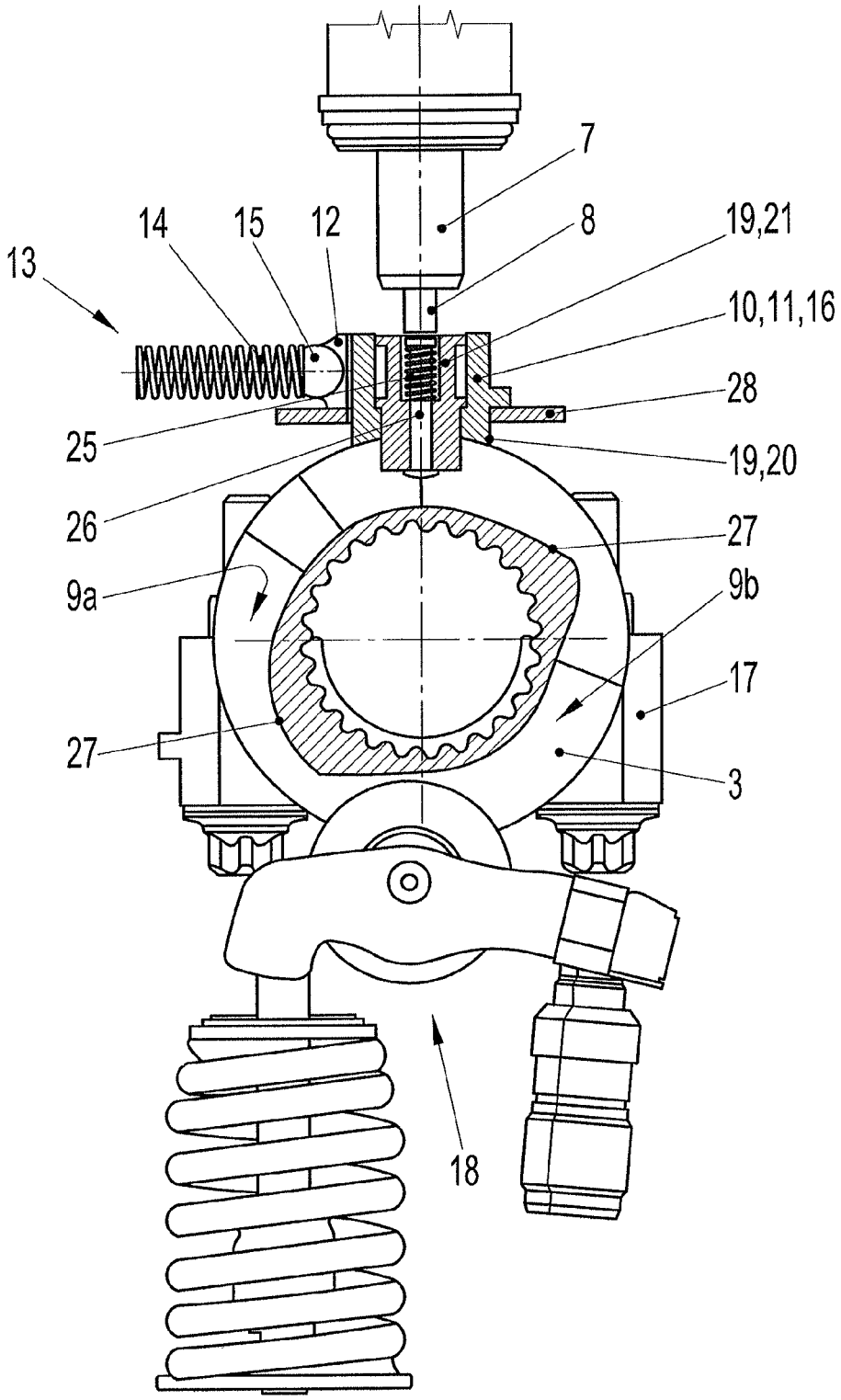
FIG. 3 shows the detail according to FIG. 1 in a side view rotated through 90° compared to FIG. 1.
Figure 4:
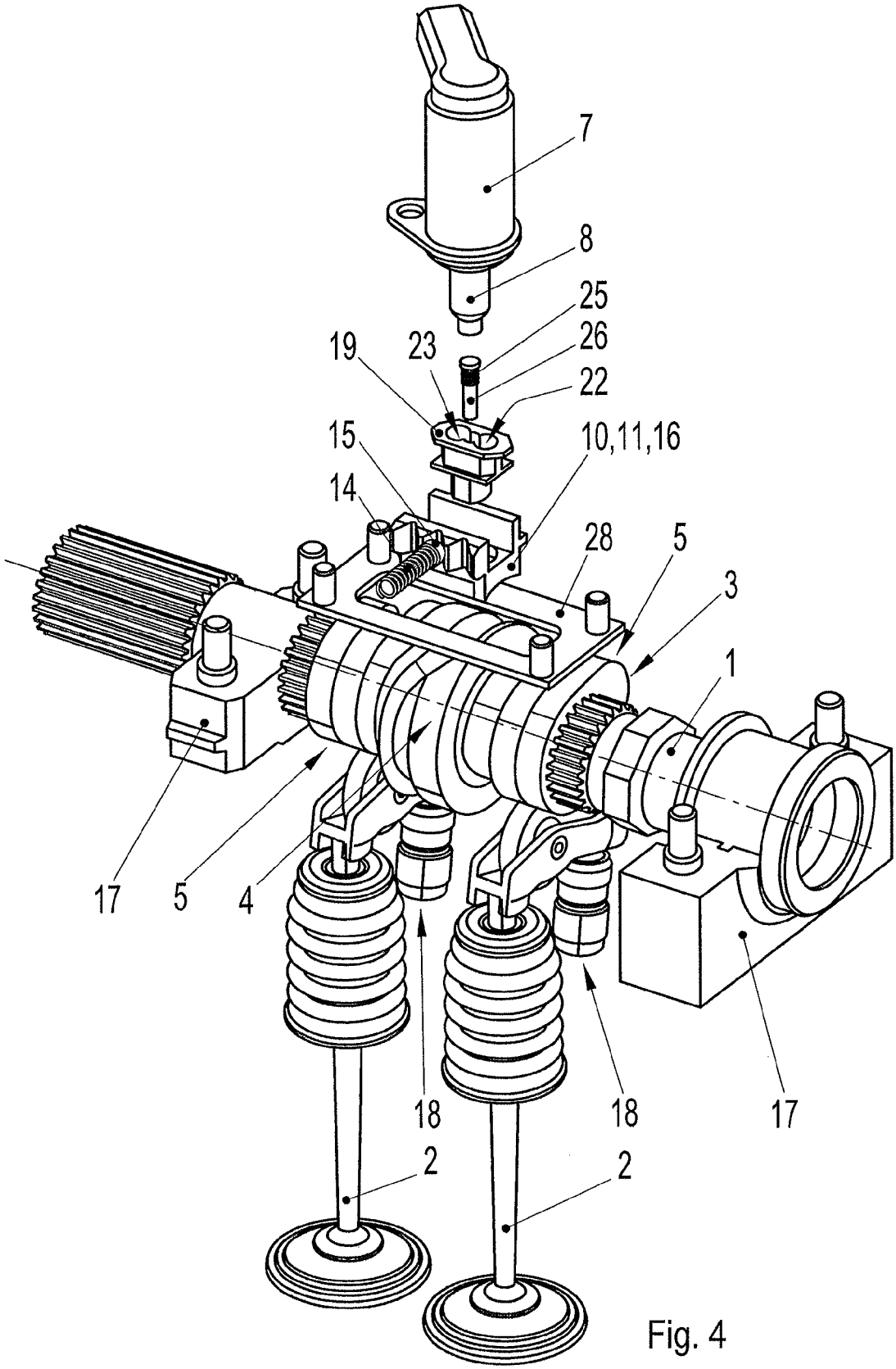
FIG. 4 shows the detail according to FIG. 1 in a perspective view.
Figure 5:
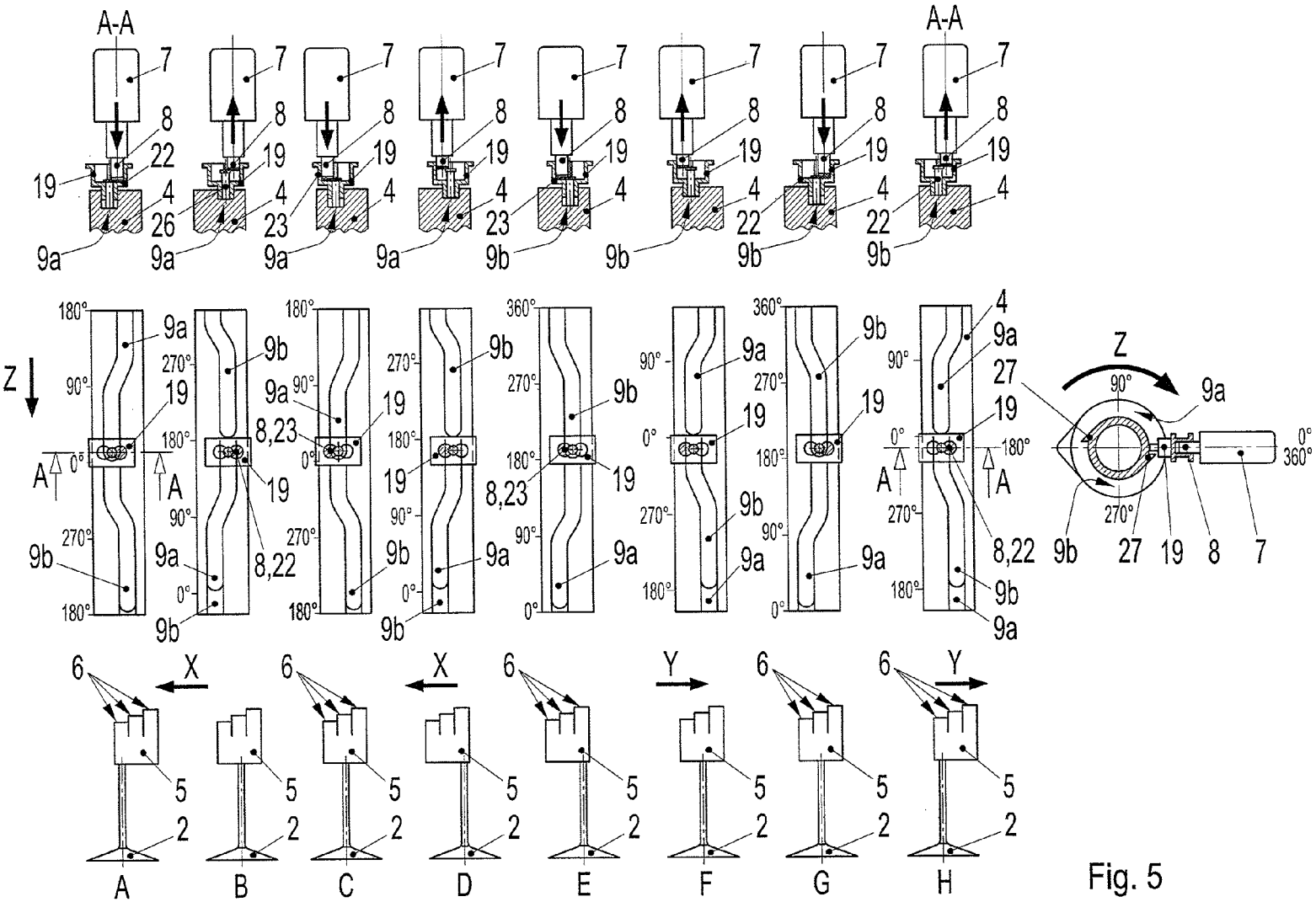
FIG. 5 shows a schematic diagram clarifying the method of functioning of the slotted link section of the sliding cam and of the actuator which interacts with the slotted link section.

As can be inferred best from FIGS. 3 and 5, the slotted link section 4 of the axially slideable sliding cam 3 comprises a plurality of grooves which are positioned one behind the other in the circumferential direction of the slotted link section 4 and therefore on the circumference of the sliding cam 3, specifically a first groove 9*a* for axially sliding the sliding cam 3 in a first axial direction and a second groove 9*b* for axially sliding the sliding cam 3 in an opposite, second axial direction. The grooves 9*a* and 9*b* positioned one behind the other in the circumferential direction of the slotted link section 4 are each contoured here in an S shape, wherein these grooves 9*a* and 9*b* are formed one behind the other in the circumferential direction on the slotted link section 4 on an outer lateral surface of the slotted link section 4, and accordingly extend over different circumferential sections of the sliding cam 3 and therefore of the slotted link section 4. The first groove 9*a* which is contoured in an S shape brings about sliding of the sliding cam 3 in the diagram of FIG. 5 and therefore brings about sliding of the cam section 5 (shown in FIG. 5) to the left according to arrows X, while the second groove 9*b* which is contoured in an S shape and is positioned behind the first groove 9*a* in the circumferential direction brings about sliding of the sliding cam 3 according to the arrows Y, and therefore sliding of the cam section 5 to the right according to the arrows Y. Both grooves 9*a* and 9*b* which are contoured in an S shape together define a slotted link section 4 which is contoured in a double S shape.

Figure 2:
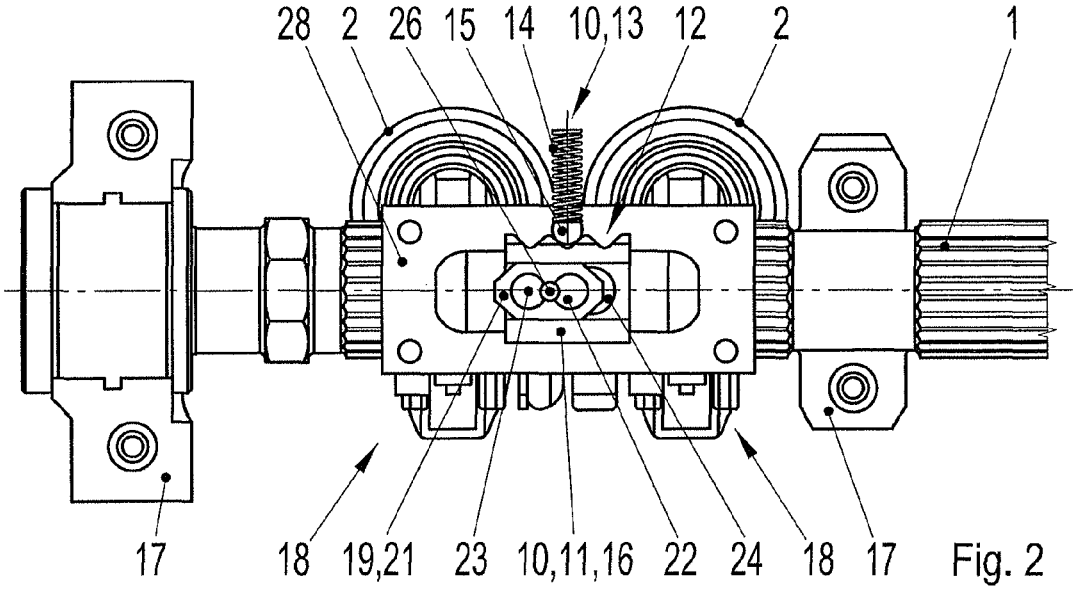
FIG. 2 shows the detail according to FIG. 1 in a view from above.

After axial sliding of the sliding cam 3 relative to the cam shaft 1, the axial relative position of the sliding cam 3 on the cam shaft 1 relative to a charge cycle valve which is to be activated can be locked or latched by means of a locking device 10, wherein the locking device 10 which interacts with the sliding cam 3 comprises a first latching element 11 with a plurality of latching depressions 12, and a second latching element 13 which interacts with the first latching element 11 and which comprises a latching ball 15 on which a spring element 14 acts. Depending on the relative position of the sliding cam 3 which is to be locked on the cam shaft 1, the latching ball 15 of the second latching element 13 engages in one of the latching depressions 12 in the first latching element 11. In FIG. 2, the latching ball 15 of the second latching element 13 engages in the central latching depression 12 in the first latching element 11.

A sliding sleeve 16 is positioned radially on the outside of the sliding cam 3, which sliding sleeve 16 is held on the sliding cam 3 so as to be axially non-slideable with respect to said sliding cam 3, but can be moved axially relative to the cam shaft 1 together with the sliding cam 3. This sliding sleeve 16 makes available the first latching element 11 of the locking device 10 with the plurality of latching depressions 12, this being specifically according to FIG. 2 a section of the sliding sleeve 16 which extends in the axial direction of the cam shaft 11.

The second latching element 13 of the locking device 10, said latching element 13 interacting with the first latching element 11 made available by the sliding sleeve 16, is mounted or accommodated together with the actuator 7 in a cylinder head cover (not shown in detail) of the internal combustion engine in the exemplary embodiment shown. Only a cover 28 is shown of the cylinder head cover, which cover 28 can be screwed to the cylinder head cover and serves to cover a receptacle opening of the cylinder head cover for the actuator 7 and the second latching element 13.

In contrast to this, it is also possible to mount these elements, that is to say the second latching element 13 of the locking device 10 and the actuator 7, in the cylinder head. When the cylinder head is formed from a cylinder head lower part and a cam shaft housing which is positioned between the cylinder head cover and the cylinder head lower part, the second latching element 13 and the actuator 7 can be accommodated or mounted together in the cam shaft housing.

In the valve drive according to the invention, the actuator 7, specifically the pin 8 thereof, does not interact directly with the grooves 9*a*, 9*b* of the slotted link section 4 of the sliding cam 3 but rather instead indirectly with the intermediate arrangement of the sliding piece 19. The sliding piece 19 is preferably permanently engaged, by means of a first section 20, with one of the grooves 9*a*, 9*b* of the respective slotted link section 4 of the sliding cam 3. A second section 21, lying opposite the first section 20, of the sliding piece 19 interacts with the pin 8 of the actuator 7. Therefore, when the actuator 7 is activated, or the pin 8 of said actuator 7 is released through energization of said actuator 7 is engaged in a positively locking fashion with the second section 21 of the sliding piece 19 in order to bring about axial sliding of the sliding cam 3 on the cam shaft 1.

As can be inferred best from FIGS. 1 and 2, two regions 22 and 23 are formed one next to the other when viewed in the axial direction on the second section 21 of the sliding piece 19 which interacts with the actuator 7, specifically the pin 8 thereof, which serve to receive the pin 8 of the actuator 7 in a positively locking fashion. A first region 22 of the second section 21 of the sliding piece 19 therefore serves to axially slide the respective sliding cam 8 in both directions X and Y (see FIG. 5) about a first axial segment in order to bring about stroke adjustment between two directly adjacent cam tracks 6 of the respective cam section 5. An axially adjacent second region 23 of the second section 21 of the sliding piece 19 serves to make available the axial sliding of the respective sliding cam 3 in the two directions about a second axial segment in order to ensure the adjustment between two other directly adjacent cam tracks 6 of the cam section 5. Given corresponding axial sliding of the respective sliding cam 3 about the respective axial segment, the pin 8 of the actuator 7 is engaged in a positively locking fashion with the respective region 22, 23 of the second section 21 of the sliding piece 19.

From FIG. 5 it can be inferred that in the first axial segment of the axial sliding of the sliding cam 3, relative axial sliding of the sliding cam 3 and therefore sliding of the cam section 5 shown in FIG. 5 relative to the inlet valve 2 occurs between a cam track 6, which brings about a relatively small stroke on the respective inlet valve 2, and a cam track 6, which brings about a medium-sized stroke of the respective inlet valve 2.

In FIG. 5, the sliding of the sliding cam 3 and therefore of the cam section 5 occurs in this first axial segment between the states A and B as well as between the states G and H.

In the second axial segment of the axial sliding of the sliding cam 3, a relative axial movement thereof occurs, and therefore a relative axial movement of the cam section 5 relative to the inlet valve 2 occurs between the cam track 6, which brings about the medium-sized stroke of the respective inlet valve 2, and a cam track 6, which brings about a relatively large stroke of the respective inlet valve 2.

In FIG. 5, this movement of the sliding cam 3, and therefore the movement of the cam section 5, in the second axial segment occurs between the states C and D as well as the states E and F.

The above transitions between these states differ in each case in the direction of the axial movement of the sliding cam 3 relative to the cam shaft 1, specifically in such a way that, between the states A and B and the states C and D, a movement of the cam section 5 occurs in each case in the direction X to the left, and between the states E and F as well as the states G and H, a movement thereof occurs in each case in the direction Y to the right.

When the cam section 5 according to FIG. 5 is to be changed over from the state A, that is to say from a state with the active cam track 6 for the small stroke of the inlet valve 2, into the state B, that is to say into a state with the active cam track 6 for the medium-sized stroke of the inlet valve 2, that is to say when an axial movement of the sliding cam 3 is to take place in the first direction X in the first axial segment, the pin 8 of the actuator 7 is placed in engagement in a positively locking fashion with the first region 22 of the second section 21 of the sliding piece 19, wherein by rotating the cam shaft 1, and therefore the sliding cam 3 in the rotational direction Z (shown in FIG. 5) relative to the fixed actuator 7 and fixed pin 8 thereof, the sliding cam 3 is moved in the first axial direction X in the first axial segment. At the same time, the first groove 9*a* of the slotted link section 4 becomes effective, for which purpose the first section 20 of the sliding piece 19 interacts with the first groove 9*a* in the slotted link section 4.

If the sliding cam 3 and therefore the cam section 5 are to be moved on axially in this first, axial direction X, that is to say are to be changed over from the state C into the state D and therefore slid in the second axial segment, the pin 8 of the actuator 7 is introduced in a positively locking fashion into the second region 23 of the second section 21 of the sliding piece 19, wherein, by rotating the cam shaft 1 and therefore the sliding cam 3 again in the rotational direction Z relative to the fixed actuator 7, the sliding cam 3 is moved further in the first axial direction X in the second axial segment. When this axial movement of the sliding cam 3 occurs in the first, axial direction X, the first groove 9*a* of the slotted link section 4 in turn becomes effective, and accordingly during this axial movement the first section 20 of the sliding piece 19 engages in the first groove 9*a* in the slotted link section 4.

The second groove 9*b* of the slotted link section 4 is used to move the sliding cam 3 in the opposite, second axial direction Y, wherein, in order to slide the sliding cam 3 axially in the second direction Y in the second axial segment, that is to say in order to change over the cam section 5 from the state E into the state F, the pin 8 is engaged in a positively locking fashion with the second region 23 of the second section 21 of the sliding piece 19, and wherein, in order to move the sliding cam 3 axially in the second direction Y in the first axial segment, that is to say in order to change over the cam section 5 from the state G into the state H, the pin 8 of the actuator 7 is engaged in a positively locking fashion with the first region 22 of the second section 21 of the sliding piece 19.

As already mentioned, during the movement in the direction Y the second groove 9*b* of the slotted link section 4 is effective in both axial segments, with the result that in this case the first section 20 of the sliding piece 19 engages in this second groove 9*b*.

As already stated, the grooves 9*a* and 9*b*, which are each contoured in an S shape, are positioned one behind the other in the circumferential direction of the slotted link section 4, with the result that said grooves 9*a* and 9*b* accordingly extend over different circumferential sections of the slotted link section 4 and therefore of the sliding cam 3. Both grooves 9*a* and 9*b* (see, in particular, FIGS. 3 and 5) each extend over a circumferential section of, in each case, approximately 180° of the slotted link section 4.

From the above relationships it follows accordingly that either the first groove 9*a* or the second groove 9*b* of the slotted link section 4 becomes effective depending on the desired direction X or Y of the axial sliding of the sliding cam 3 on the cam shaft 1. In order to slide the sliding cam 3 in the axial direction X, the groove 9*a* is effective, while in order to slide the sliding cam 3 in the direction Y, the second groove 9*b* is effective. Depending on the desired axial segment of the axial sliding of the sliding cam 3 on the cam shaft 1, the pin 8 of the actuator 7 engages in a positively locking fashion in one of the regions 22, 23 of the sliding piece 19 which is engaged by its first section 20 with the respective groove 9*a* or 9*b*. For the axial sliding of the cam shaft 3 in the first axial segment, that is to say for changing over between a cam track 6 for a small valve stroke and a cam track 6 for a medium-sized valve stroke, the pin 8 is engaged in a positively locking fashion with the first region 22 of the second section 21 of the sliding piece 19. On the other hand, in order to slide axially in the second axial segment, that is to say in order to change over the cam section 5 between a cam track 6 with the medium-sized valve stroke and a cam track 6 with a large stroke, the pin 8 of the actuator 7 is engaged in a positively locking fashion with the second region 23 of the second section 21 of the sliding piece 19.

As can be inferred best from FIG. 2, the sliding piece 19 is guided in an axially slideable fashion in an elongate hole 24 of the sliding sleeve 16 which makes available the first latching element 11 with the latching depressions 12. When the actuator 7, specifically the pin 8 thereof, engages in one of the regions 22, 23 of the second section 21 of the sliding piece 19, the sliding piece 19 is secured by the actuator 7 in its axial position, wherein in the process axial sliding of the sliding cam 3 on the cam shaft 1, together with the sliding sleeve 16, then occurs through rotation of the cam shaft 1. When the sliding piece 19 is axially fixed, the sliding sleeve 16 is accordingly axially movable relative to the sliding piece 19, with simultaneous axial sliding of the sliding cam 3. When the actuator 7, specifically the pin 8 thereof, does not engage in a positively locking fashion in one of the regions 22, 23 of the second section 21 of the sliding piece 19, both the sliding cam 3 and the sliding sleeve 16 are secured axially, wherein the sliding piece 19, which engages with the first section 20 in one of the grooves 9*a* or 9*b* of the slotted link section 4, can then be moved relative to the sliding sleeve 16.

The dimensions of the elongate hole 24 in the axial direction limit the axial relative sliding between the sliding piece 19 and the sliding sleeve 16 both when the pin 8 of the actuator 7 engages in the sliding piece 19 and when the pin 8 of the actuator 7 does not engage in the sliding piece 19.

In order to move the pin 8 of the actuator 7 out of the corresponding region 22, 23 of the second section 21 of the sliding piece 19 in an axially outward direction again after axial sliding of the sliding cam 3 has taken place, a return pin 26, which is acted on by a spring element 25, interacts with the sliding piece 19. When the pin 8 engages in a positively locking fashion in one of the regions 22, 23 of the second section 21 of the sliding piece 19, the pin 8 of the actuator 7 pushes the return pin 26 radially inward counter to the spring force made available by the spring element 25. When the cam shaft 1 rotates, the return pin 26 then comes to bear on a ramp-like return element 27 of the respective groove 9*a* or 9*b* of the slotted link section 4, as a result of which the return pin 26 is then moved radially outward in order in this way also to move the pin 8 of the activation element 7 radially outward into its latching position in the actuator 7. When an actuator 7 is energized, the pin 8 thereof is released, with the result that said pin 8 can engage in a positively locking fashion in one of the regions 22, 23 of the second section 21 of the sliding piece 19. By means of the ramp-like return elements 27, which interact with the return pin 26, it is then possible to cause the pin 8 of the actuator 7 to be latched again properly in the actuator 7. The ramp-like return elements 27 are formed here in the region of each groove 9*a*, 9*b* of the slotted link section 4. Said return elements 27 extend radially outward from the respective groove base of the respective groove 9*a* or 9*b*.

List of Reference Numbers

1 Cam shaft
2 Inlet valve
3 Sliding cam
4 Slotted link section
5 Cam section
6 Cam track
7 Actuator
8 Pin
9*a* Groove
9*b* Groove
10 Locking device
11 First latching element
12 Latching depression
13 Second latching element
14 Spring element
15 Latching ball
16 Sliding sleeve
17 Cam shaft bearing
18 Cam follower
19 Sliding piece
20 First section
21 Second section
22 First region
23 Second region
24 Elongate hole
25 Spring element
26 Return pin

27 Return element
28 Cover

What is claimed:

1. An internal combustion engine having a plurality of cylinders, a cylinder head and a cylinder head cover which is embodied separately from the cylinder head or integrated with the cylinder head as one piece, wherein in order to activate charge cycle valves, at least one rotatably mounted cam shaft is provided with at least one sliding cam which is configured to be slid axially on the respective cam shaft, wherein the respective sliding cam has at least one slotted link section with at least one groove formed on an outer lateral surface of the respective slotted link section, an actuator that is configured to bring about axial sliding of the respective sliding cam, wherein after axial sliding on the respective cam shaft, the respective sliding cam is configured to be latched in an axial relative position relative to a charge cycle valve to be activated by a locking device, which has a first latching element with a plurality of latching depressions and at least one second latching element which interacts with the first latching element, and wherein a first section of a sliding piece is configured to be engaged with said respective groove of the respective slotted link section and a second section of the sliding piece is configured to be placed in engagement with the actuator in order to axially slide the sliding cam.

2. The internal combustion engine as claimed in claim 1, wherein the respective slotted link section has a plurality of grooves which are positioned one behind the other on a circumference of the slotted link section, said plurality of grooves including a first groove for axially sliding the sliding cam in a first direction and a second groove for axially sliding the sliding cam in an opposite, second direction, and wherein, in order to bring about the axial sliding of the respective sliding cam in both directions, the actuator is engaged in a positively locking fashion about a first axial segment with a first region of the second section of the sliding piece, and, in order to bring about the axial sliding of the respective sliding cam in both directions, the actuator is engaged in a positively locking fashion about a second axial segment with a second region of the second section of the sliding piece.

3. The internal combustion engine as claimed in claim 1, wherein a sliding sleeve which is configured to slide axially together with the respective sliding cam, and which makes available the first latching element with the plurality of latching depressions, is positioned radially on an outside of the respective sliding cam, and wherein the sliding piece is guided in an axially slideable fashion in the sliding sleeve in such a way that when the sliding cam is axially fixed and the sliding sleeve is axially fixed, the sliding piece which is released by the actuator is configured to be moved relative to the sliding sleeve, whereas when the sliding piece is axially fixed by the actuator, the sliding sleeve can be moved with simultaneous axial sliding of the sliding cam relative to the sliding piece.

4. The internal combustion engine as claimed in claim 3, wherein the sliding piece is guided in an axially slideable fashion in an elongate hole of the sliding sleeve.

5. The internal combustion engine as claimed in claim 4, wherein the elongate hole limits the axial relative sliding between the sliding piece and the sliding sleeve.

6. The internal combustion engine as claimed in claim 1, wherein the second latching element, or each second latching element, which interacts with the first latching element, is mounted together with the respective actuator in the cylinder head or in the cylinder head cover.

7. The internal combustion engine as claimed in claim 1, wherein the cylinder head is formed from a cylinder head lower part and a cam shaft housing which is positioned between the cylinder head cover and the cylinder head lower part, and wherein the second latching element, or each second latching element, which interacts with the first latching element, is mounted together with the respective actuator either in the cam shaft housing or in the cylinder head cover.

8. The internal combustion engine as claimed in claim 1, wherein the slotted link section of the respective sliding cam is positioned in the center between two axially outer cam sections which each have a plurality of cam tracks for setting different valve strokes.

9. A valve drive for an internal combustion engine, which, in order to activate charge cycle valves of the internal combustion engine, has at least one rotatably mounted cam shaft with at least one sliding cam which is configured to be slid axially on the respective cam shaft, wherein the respective sliding cam has at least one slotted link section with at least one groove formed on an outer lateral surface of the respective slotted link section, an actuator that is configured to bring about axial sliding of the respective sliding cam, wherein after axial sliding on the respective cam shaft, the respective sliding cam is configured to be latched in its axial relative position relative to a charge cycle valve to be activated by a locking device, which has a first latching element with a plurality of latching depressions and at least one second latching element which interacts with the first latching element, a first section of a sliding piece which is engaged with the respective groove of the respective slotted link section and a second section of the sliding piece is configured to be placed in engagement with the actuator in order to axially slide the sliding cam.

* * * * *